US008511120B2

(12) United States Patent
Cahill et al.

(10) Patent No.: US 8,511,120 B2
(45) Date of Patent: Aug. 20, 2013

(54) ELECTRONIC LOCKING SYSTEM TO SECURE CONSUMABLE ITEM IN AN IMAGE FORMING DEVICE AND A METHOD THEREFOR

(75) Inventors: Daniel Paul Cahill, Verona, KY (US); Chad Michael Plening, Lexington, KY (US); Louann Behymer Samuels, Georgetown, KY (US); Thomas Campbell Wade, Lexington, KY (US); Curtis Duane Woodson, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 762 days.

(21) Appl. No.: 12/631,542

(22) Filed: Dec. 4, 2009

(65) Prior Publication Data

US 2011/0133615 A1 Jun. 9, 2011

(51) Int. Cl.
*E05B 69/00* (2006.01)

(52) U.S. Cl.
USPC ..... 70/58; 70/63; 70/85; 70/277; 70/278.1; 340/5.51

(58) Field of Classification Search
USPC ..... 70/58, 63, 85–87, 275, 277, 278.1; 109/19; 312/237; 340/5.51
See application file for complete search history.

(56) References Cited

U.S. PATENT DOCUMENTS

| | | | | |
|---|---|---|---|---|
| 2,145,314 | A * | 1/1939 | Murtaugh, Jr. | 70/85 |
| 4,649,833 | A * | 3/1987 | Cummins | 109/25 |
| 4,988,987 | A * | 1/1991 | Barrett et al. | 340/5.28 |
| 5,206,637 | A * | 4/1993 | Warren | 340/5.22 |
| 5,206,696 | A * | 4/1993 | Hirobe et al. | 399/377 |
| 5,385,039 | A * | 1/1995 | Feldpausch et al. | 70/78 |
| 5,894,277 | A * | 4/1999 | Keskin et al. | 340/5.21 |
| 6,259,352 | B1 * | 7/2001 | Yulkowski et al. | 340/5.7 |
| 6,345,522 | B1 * | 2/2002 | Stillwagon et al. | 70/277 |
| 6,843,081 | B1 * | 1/2005 | Painter | 70/63 |
| 6,867,685 | B1 * | 3/2005 | Stillwagon | 340/5.64 |
| 7,116,224 | B2 * | 10/2006 | Mickler | 340/568.1 |
| 7,145,436 | B2 * | 12/2006 | Ichikawa et al. | 340/5.72 |
| 7,178,370 | B2 * | 2/2007 | Engel | 70/63 |
| 7,761,907 | B2 * | 7/2010 | Osaka | 726/4 |

* cited by examiner

*Primary Examiner* — Suzanne Barrett
(74) *Attorney, Agent, or Firm* — William F. Esser

(57) ABSTRACT

An electronic locking system to secure consumable items in an image forming device and a method therefore. In one embodiment of the invention, an electronic locking system to secure media sheets includes a media tray to hold media sheets, a tray receiving member for receiving the media tray, and a controller. The tray receiving member includes a drive device and a plunger. The plunger is moved by the drive device between a locked and an unlocked position. The controller is configured to control the drive device to move the plunger to engage a portion of the media tray in the locked position and to move the plunger to disengage from the portion of the media tray in the unlocked position. The electronic locking system, incorporating the controller, provides an effective and efficient way to lock/unlock the media tray and eliminates the use of mechanical keys.

17 Claims, 8 Drawing Sheets

ELECTRONIC LOCKING SYSTEM TO SECURE CONSUMABLE ITEM IN AN IMAGE FORMING DEVICE AND A METHOD THEREFOR

BACKGROUND

1. Field of the Invention

The present invention relates generally to an electronic locking system to secure consumable items in an image forming device, and particularly to an electronic locking system for a media tray to secure media sheets in an image forming device.

2. Description of the Related Art

Image forming devices generally use consumable items like toner, media sheets, etc., to execute printing. The image forming device generally includes containers to hold the consumable items, e.g., the image forming device includes a media tray to hold media sheets. The consumable item may include valuable media sheets like doctors' prescriptions, bankers' bearer bonds, etc. As can be seen, it is necessary to securely maintain such valuable media sheets inside the image forming device, so as to prevent the media sheets from being improperly used. Even rather modestly valuable consumable material such as toner or ink, when used in an environment in which a relatively large number of people have access to the consumable material, may need to be secured so as to prevent their theft.

A mechanical locking system is well known in the art for locking the media trays. In prior mechanical locking systems, a mechanical key is used to lock the media tray within the image forming device. However, it may be impractical for one user to carry the mechanical key for each and every media tray. Further, if any of the mechanical keys are lost, the manufacturer has to make a new serialized key. The time consumed in making the new serialized key may cause an unnecessary interruption in printing. Moreover, an unlocked media tray may be easily opened at an inopportune time, e.g., while the image forming device is printing, which generally causes paper jams.

It would therefore be desirable to provide an effective locking system that obviates the above-mentioned problems.

SUMMARY OF THE INVENTION

Disclosed herein is an electronic locking system to secure consumable items in an image forming device. The system includes a first member to hold the consumable item and which is movable between an open position and a closed position; a receiving member configured to receive the first member, the receiving member including a locking member; and a controller for controlling the locking member to lock the first member to the receiving member when the first member is in the closed position and to unlock the first member from the receiving member so that the first member is movable to the open position.

In some embodiments, the locking member includes a drive device and a plunger such that the drive device moves the plunger between a lock and an unlock position. The controller is configured to control the drive device to move the plunger to engage a portion of the first member in the lock position, and to move the plunger to disengage from the portion of the first member in the unlock position.

In some embodiments, the image forming device includes an I/O interface for receiving codes such that when a correct code is received the controller controls the drive device to move the plunger to the unlock position.

In other embodiments, the controller controls the drive device to move the plunger to the unlock position only when the image forming device is not printing.

In some embodiments, the controller records the time the correct code is entered into the image forming device and stores the recorded time along with the corresponding correct code in a memory.

In another embodiment, the first member comprises a media tray, the consumable item comprises one or more sheets of media, and the receiving member comprises a tray receiving member.

In other embodiments, the tray receiving member includes a sensing member that detects the media tray disposed within the tray receiving member and, in response to detection by the sensing member, the controller controls the drive device to move the plunger to the lock position.

In other embodiments, following the controller controlling the drive device to move the plunger to the unlock position, the controller controls the drive device to move the plunger to the lock position upon completion of a predetermined time period during which the media tray remains positioned inside the tray receiving member as sensed by the sensing member.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention and are intended to provide an overview or framework for understanding the nature and character of the invention as it is claimed. The accompanying drawings are included to provide a further understanding of the invention and are incorporated into and constitute a part of this specification. The drawings illustrate various embodiments of the invention and together with the description serve to explain the principles and operation of the invention.

BRIEF DESCRIPTION OF THE DRAWINGS

The above-mentioned and other features and advantages of the various embodiments of the invention, and the manner of attaining them, will become more apparent and will be better understood by reference to the accompanying drawings, wherein.

DETAILED DESCRIPTION

Figure 1:
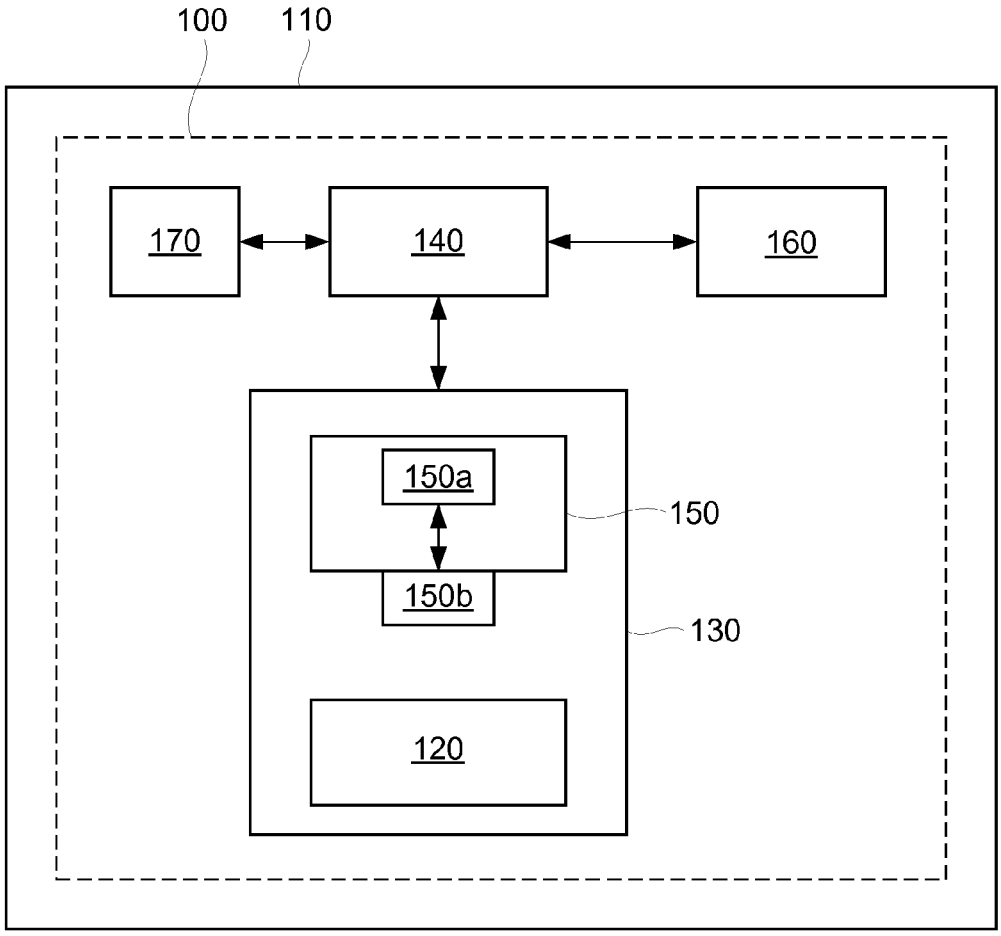
FIG. 1 is a block diagram of one embodiment of an electronic locking system to secure consumable items in an image forming device according to the present invention.

Reference will now be made in detail to the exemplary embodiment(s) of the invention, examples of which are illustrated in the accompanying drawings. Whenever possible, the same reference numerals will be used throughout the drawings to refer to the same or like parts.

FIG. 1 illustrates one embodiment of an electronic locking system 100 to secure consumable items in an image forming device 110 according to the present invention. The electronic locking system 100 includes a first member 120 to hold consumable items, a receiving member 130 to receive the first member 120, and a controller 140. The first member 120 is movable between an open and a closed position relative to the receiving member 130. In the closed position, the first member 120 is positioned inside the receiving member 130. The receiving member 130 includes a locking member 150. The controller 140 controls the locking member 150 to lock the first member 120 to the receiving member 130 in the closed position. The controller 140 also controls the locking member 150 to unlock the first member 120 from the receiving member 130 so that the first member 120 is movable to the open position. In the open position, the first member 120 provides access to the consumable item. Generally, the receiving member 130 is an opening formed inside a housing 200 (shown in FIG. 2) of the image forming device 110 and the first member 120 is movably positioned within the receiving member 130.

The locking member 150 comprises a drive device 150*a* and a plunger 150*b*. Essentially, the drive device 150*a* moves/drives the plunger 150*b* between a locked and an unlocked position. The drive device 150*a* may be a motor, a bidirectional solenoid, a servo, etc. When the first member 120 is positioned inside the receiving member 130, the controller 140 controls the drive device 150*a* to move the plunger 150*b* to the locked position. In the locked position, the plunger 150*b* engages a portion of the first member 120 preventing the first member from moving relative to the receiving member 130. Thus, when the first member 120 is locked to the receiving member 130, the consumable items in the first member 120 are inaccessible to a user or anyone who may try to remove them.

In accordance with an exemplary embodiment of the present invention, in order to unlock the first member 120 a correct code is required to be entered into the image forming device 110. The correct code is a predetermined code stored in memory 170 in the image forming device 110. The image forming device 110 includes an interface 160 to receive the code from the user. The code is either directly entered by a user or is entered through a device on which the code is stored. The device may be one of an ID card, a credit card, a thumbnail or a flash drive, and a biometric scanner (not shown). The biometric scanner may include at least one of a fingerprint scanner, a palm scanner, and an eye scanner. Once a code is received, controller 140 compares the received code with the code stored in memory 170 to determine whether the received code is a correct code.

When the correct code is entered into the image forming device 110, the controller 140 controls the drive device 150*a* to move the plunger 150*b* to the unlocked position. In the unlocked position, the plunger 150*b* is retracted and disengages from the portion of the first member 120 allowing the first member 120 to move to the open position. In the open position the consumable item is accessible to the user.

The controller 140 may record the time the correct code (or even an incorrect code in order to monitor unsuccessful attempts) is entered into the image forming device 110, i.e., when the first member 120 is unlocked. The recorded time, along with the corresponding correct code, is stored in a memory 170 associated with the image forming device 110. The recorded code and time helps in tracing the person who unlocked the first member 120 and when it was unlocked.

Figure 2:
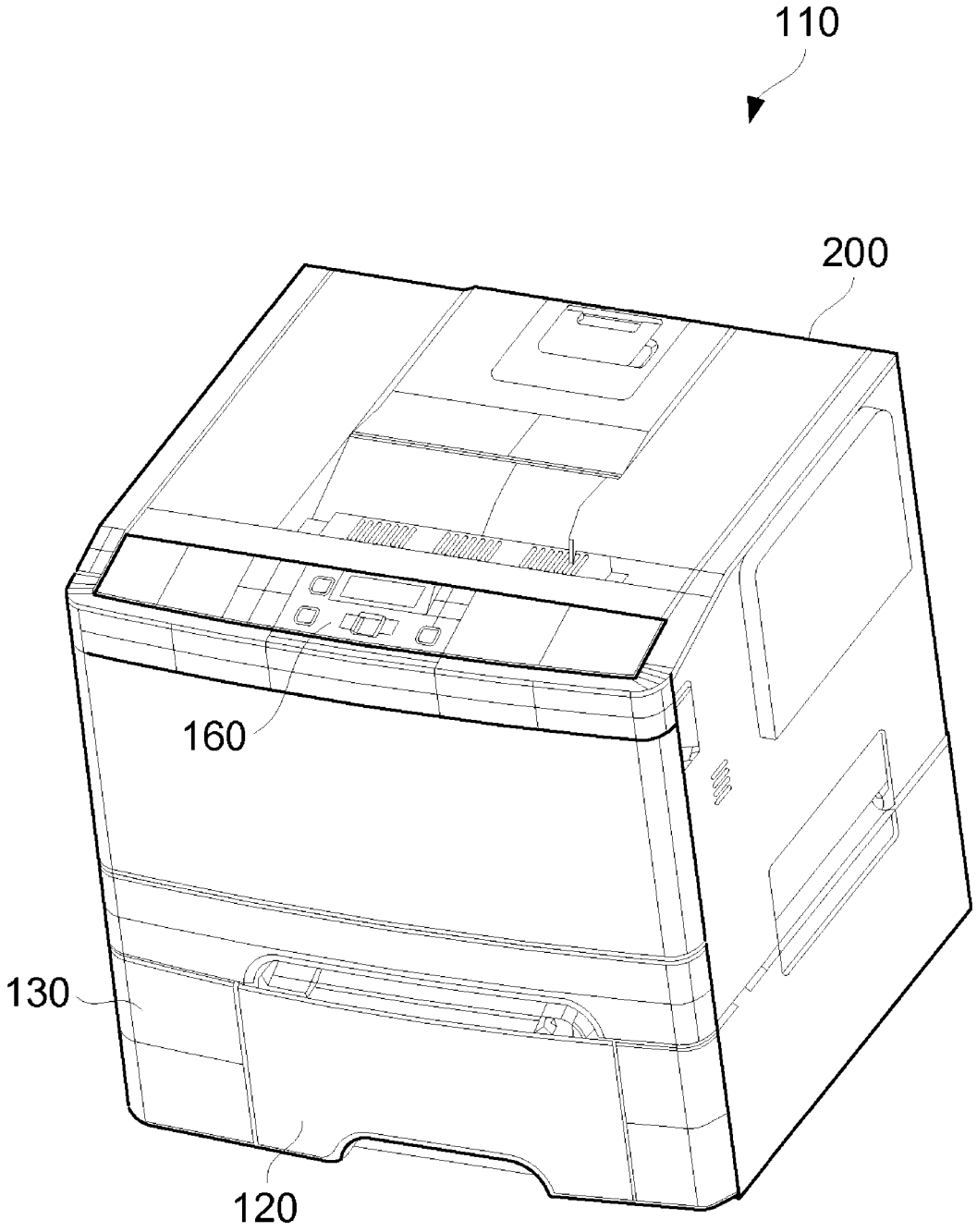
FIG. 2 is an isometric view of an image forming device that may be used in the system of FIG. 1, including a media tray electronically lockable inside a tray receiving member.
Figure 3:
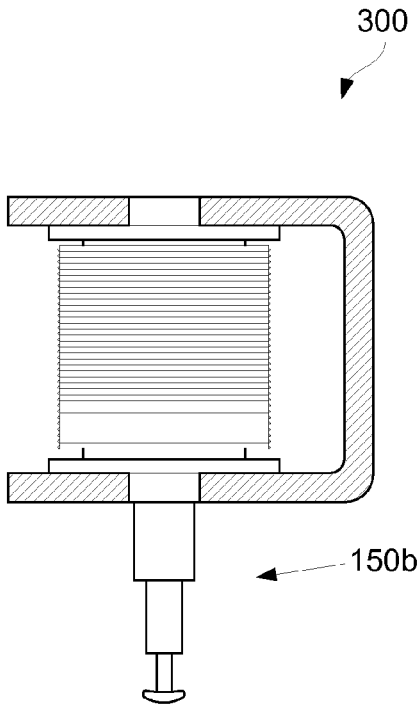
FIG. 3 is a partial cross section view of a bidirectional solenoid including a plunger attachable to the tray receiving member of FIG. 2.

In one embodiment, as illustrated in FIG. 2, the first member 120 is illustrated as a media tray 120 and the receiving member 130 is a tray receiving member. The media tray 120 is configured to hold one or more media sheets and the tray receiving member 130 is an opening in the image forming device 110. The tray receiving member 130 includes the locking member 150. The locking member 150 includes a bidirectional solenoid 300 and the plunger 150*b* coupled thereto (see FIG. 3). The bidirectional solenoid 300 moves the plunger 150*b* between the locked and the unlocked position. The controller 140 energizes the bidirectional solenoid 300 in a first direction to move the plunger 150*b* to the locked position. In the locked position, the plunger 150*b* engages a portion of the media tray 120. The controller 140 energizes the bidirectional solenoid 300 in a second direction opposite the first direction to move the plunger 150*b* to the unlocked position. In the unlocked position, the plunger 150*b* disengages from the portion of the media tray 120.

Figure 4:
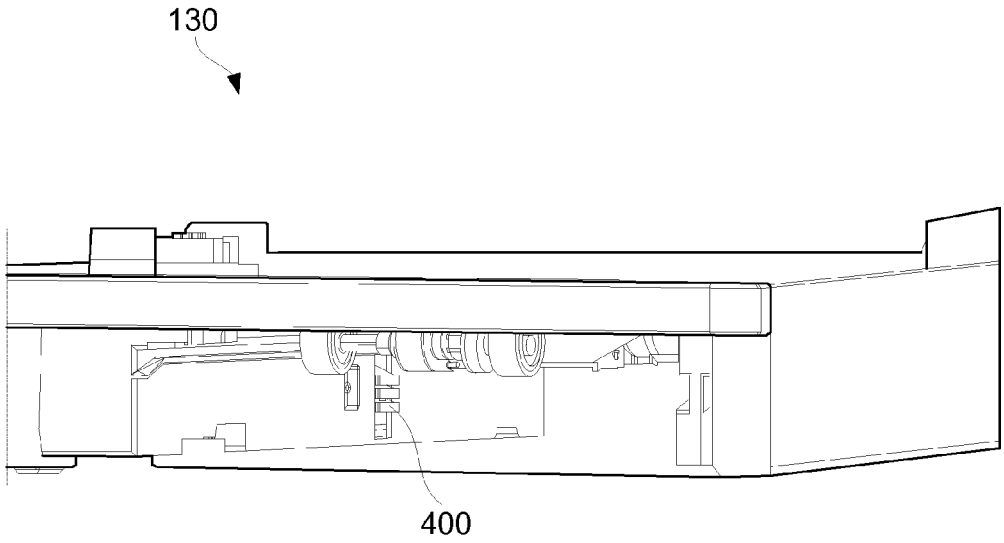
FIG. 4 is a front elevational view of the tray receiving member of FIG. 2, illustrating a sensing member to be used with the media tray.

The media tray 120 is also movable between the open and the closed position. In the closed position, the media tray 120 is positioned inside the tray receiving member 130 in the image forming device 110. The tray receiving member 130 includes a sensing member 400 (see FIG. 4), which detects if the media tray 120 is positioned inside the tray receiving member 130. The media tray 120 includes tray size sensing fingers 510 (see FIG. 5) that compresses the sensing member 400 when the media tray 120 is positioned inside the tray receiving member 130. When the sensing member 400 is compressed, the controller 140 detects that the media tray 120 is positioned inside the tray receiving member 130 and the controller 140 then energizes the bidirectional solenoid 300 to move the plunger 150*b* to the locked position.

Figure 5:
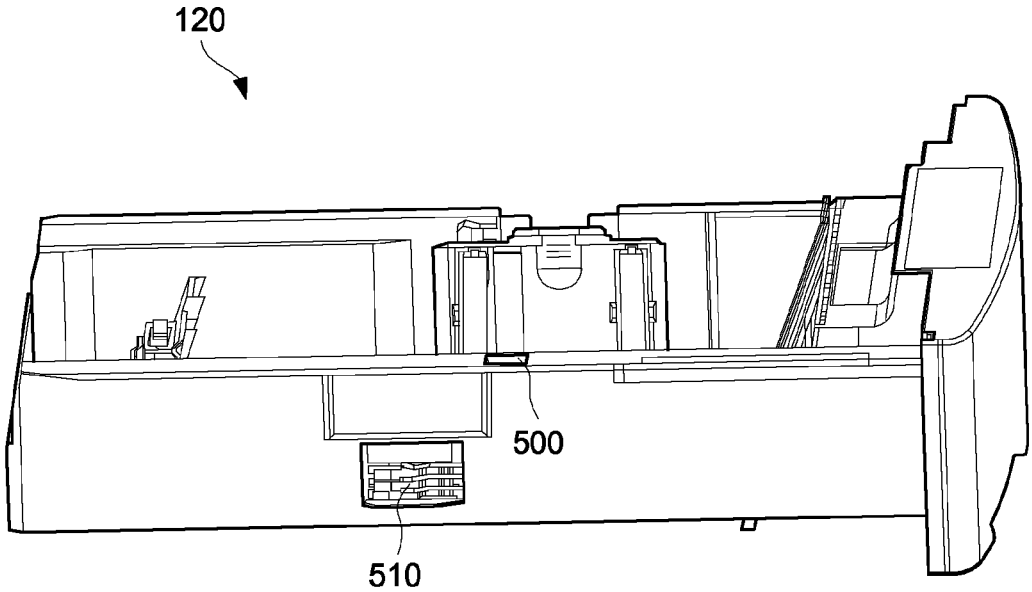
FIG. 5 is a perspective view of the media tray of FIG. 2, including a depression.
Figure 6A:
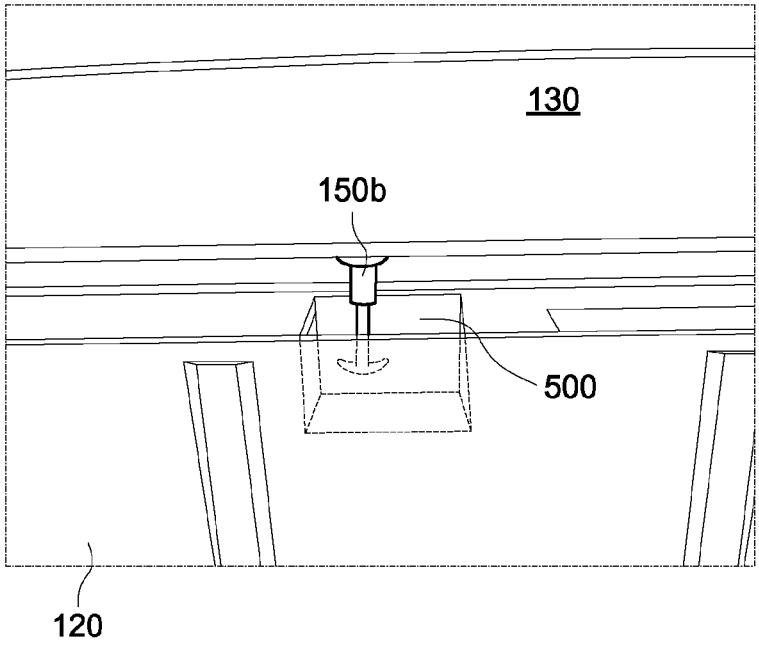
FIG. 6A is a partial perspective view of the plunger of FIG. 3 partially moved downward to engage the depression provided on the media tray of FIG. 5.

In the locked position, the plunger 150*b* engages a portion of the media tray 120. For example, the plunger 150*b* engages a depression 500 provided on the media tray 120. As shown in FIG. 5, depression 500 may be formed along an upper surface of a side member of media tray 120. The depression 500 may be an opening, a hole, a cut-out or any other concave surface to engage and/or receive the plunger 150*b* when plunger 150*b* is in the locked position and prevent the media tray 120 from being removed from the image forming device 110. The plunger 150*b* may be movable vertically in upward and downward directions but other directions are also possible and come within the scope of the present invention. When the bidirectional solenoid 300 is energized in the first direction the plunger 150*b* moves downwardly to engage (mate with) the depression 500 provided on the media tray 120. When the plunger 150*b* engages the depression 500 the media tray 120 is locked within image forming device 110 and cannot be removed. FIG. 6A illustrates the plunger 150*b* partially moved downward to lock the media tray 120. Essentially, when the media tray 120 is positioned inside the tray receiving member 130 the controller 140 energizes the bidirectional solenoid 300 in the first direction to move the plunger 150*b* downward to lock the media tray 120.

Alternatively, solenoid 300 and plunger 150*b* may be mounted on the bottom of the tray receiving member 130 such that plunger 150*b* moves upwardly to lock the media tray 120 by engaging with depression 500 formed along a bottom surface along a side of media tray 120 (not shown). Similarly, the solenoid 300 may be horizontally mounted on one side of receiving member 130 so that plunger 150*b* moves in a horizontal direction to engage with depression 500 defined along a side surface of the media tray 120.

Figure 6B:
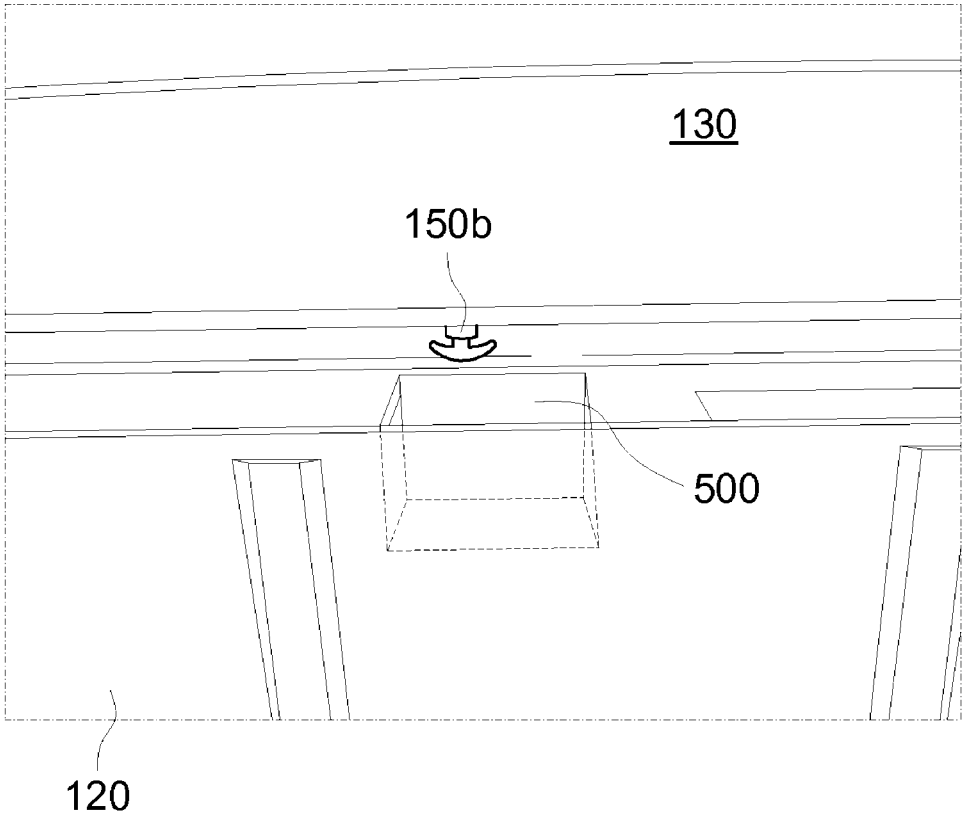
FIG. 6B is a partial perspective view of the plunger of FIG. 3 moved upward to disengage from the depression provided on the media tray of FIG. 5.

As explained above, in order to unlock the media tray 120, a code is required to be entered into the image forming device 110. When the code is entered into the image forming device 110, the controller 140 determines if the code is the correct code. It is possible that there may be more than one correct code to assist in identifying the user or for other reasons. If the code is a correct code, the controller 140 energizes the bidirectional solenoid 300 in the second direction to move the plunger 150*b* to disengage from the depression 500 (as shown in FIG. 6B) to unlock the media tray 120. In one embodiment, the controller 140 controls the bidirectional solenoid 300 to unlock the media tray 120 only when the image forming device 110 is not printing. In another embodiment, the controller 140 controls the bidirectional solenoid 300 to automatically unlock the media tray 120 when the media tray 120 is empty. The date and the time when the media tray 120 is unlocked and the corresponding correct code are stored in the memory 170 of the image forming device 110, as mentioned above.

In one embodiment, after the controller 140 controls the bidirectional solenoid 300 to move the plunger 150*b* to the unlocked position, the controller 140 controls the bidirectional solenoid 300 to return the plunger 150*b* to the locked position after a predetermined time period (a timeout period) if the media tray 120 remains positioned inside the tray receiving member 130 as sensed by the sensing member 400. This prevents the media tray 120 from being accidentally left unlocked for a prolonged period of time while remaining within tray receiving member 130. Controller 140 may include a timer or the like for monitoring the timeout period. In this regard, the timer may be activated following controller 140 causing plunger 150*b* to be moved to the unlock position and remain activated until media tray 120 is removed from tray receiving member 130. The timer may also be activated when media tray 120 is returned to the closed position within tray receiving member 130.

Figure 7:
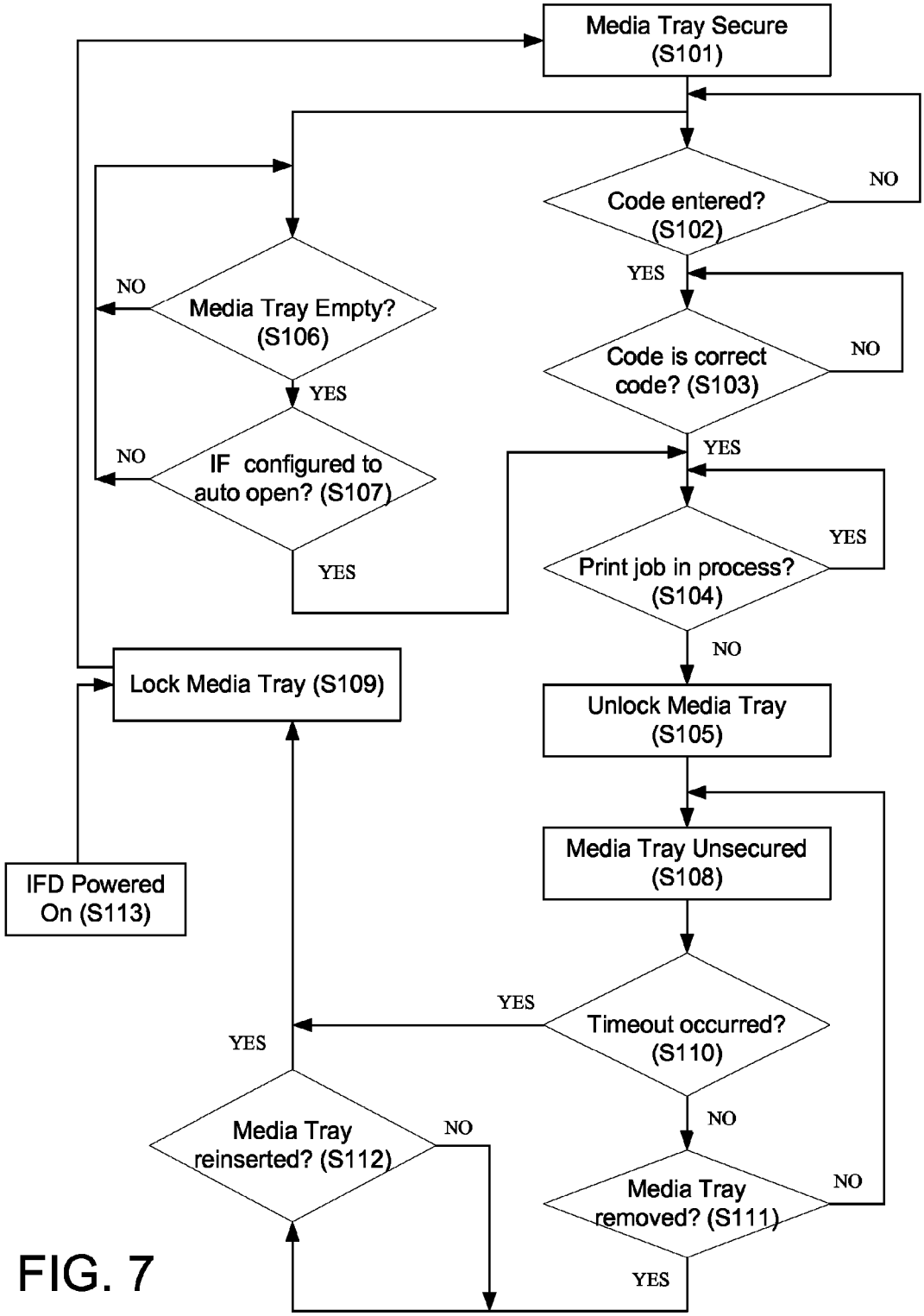
FIG. 7 is a flow chart illustrating the use of the system of FIG. 1.

FIG. 7 is a flowchart illustrating a method for electronically locking and unlocking the media tray 120. The controller 140 determines if the media tray 120 is locked and secured at S101. If the media tray 120 is secured, the controller 140 determines if a code is entered into the image forming device 110 at S102. At S103, the controller 140 determines if the code is a correct, predetermined code. If the code is the correct, predetermined code, the controller 140 determines whether the image forming device 110 is performing a printing operation at S104. If the image forming device 110 is performing the printing operation, the controller 140 delays the unlocking of the media tray 120, i.e., keeps the media tray 120 locked until the printing operation is complete. If the image forming device 110 is not printing, the controller 140 energizes the bidirectional solenoid 300 in the second direction to unlock the media tray 120 at S105.

In one embodiment, if the media tray 120 is secured at S101, the controller 140 determines if the media tray 120 is empty at S106. If the media tray 120 is empty, the controller 140 determines if the image forming device 110 is configured to automatically open at S107. If the image forming device 110 is configured to auto open, the controller 140 confirms if the print job in process at S104. In case the print job is not in process, the controller 140 energizes the bidirectional solenoid 300 to unlock the media tray 120 at S105. However, if the media tray 120 is not empty, the controller 140 keeps the media tray 120 locked.

Once the media tray 120 is unlocked and becomes unsecured at S108, the controller 140 detects if the predetermined time period occurred without media tray 120 being opened. This can be seen in blocks S110 and S111. If the timeout period occurred without media tray 120 being opened, the controller 140 energizes the bidirectional solenoid 300 to lock the media tray 120 at S109. In case the media tray 120 is removed before the timeout period has elapsed, the controller 140 determines if the media tray 120 is reinstalled at S112. If the media tray 120 is reinstalled, the controller 140 energizes the bidirectional solenoid 300 to lock the media tray 120 at S109. In one embodiment, when the image forming device 110 is powered on at S113, the controller 140 energizes the bidirectional solenoid 300 to lock the media tray 120.

Figure 8:
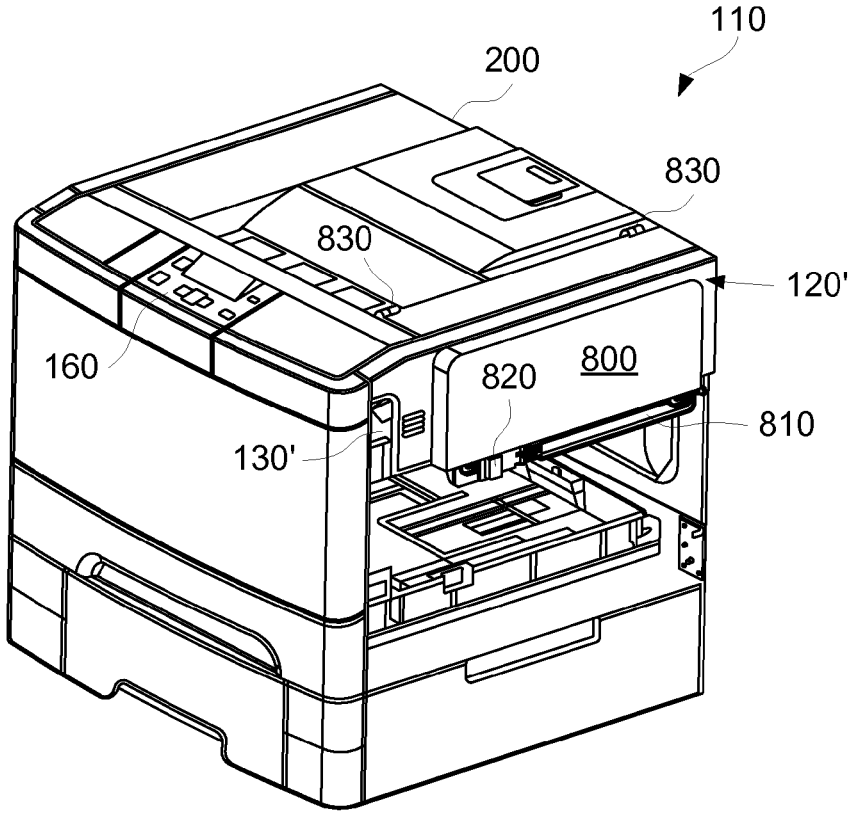
FIG. 8 is a perspective view of the image forming device of FIG. 2 including a front cover having a door electronically lockable according to the present invention.
Figure 9:
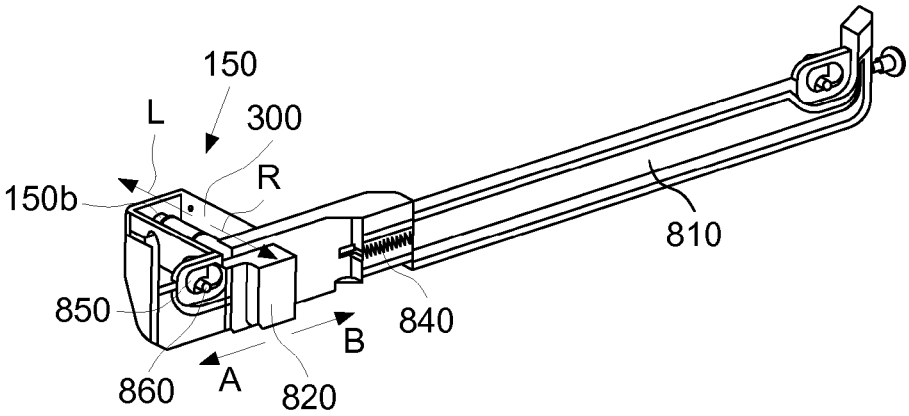
FIG. 9 is a perspective view of a latching assembly affixed to a housing of the image forming device and engaged with a locking member included inside the image forming device of FIG. 8.
Figure 10:
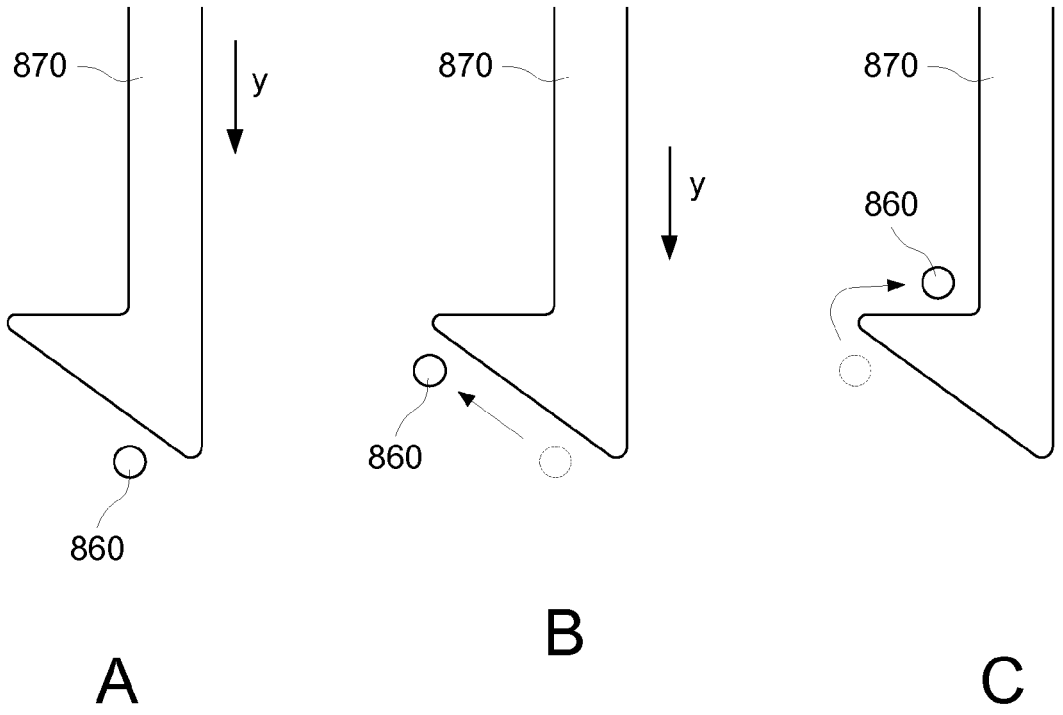
FIG. 10 is a schematic diagram of a latching member disposed on the door of FIG. 8 that moves downward to engage a pin member disposed on the latching assembly of FIG. 9.

In another embodiment according to the present invention, as illustrated in FIGS. 8-10, the first member includes a cover 120' for accessing at least one cartridge containing toner or ink, and the receiving member includes a cover receiving member 130' disposed within the housing 200 of image forming device 110. The cover 120' may be pivotally attached to the housing 200 via hinges 830. A portion of cover 120' forms a door 800 movable between an open and a closed position. When the door 800 is in the open position, the toner cartridge (s) is/are accessible. The door 800 is coupled to a latching assembly 810. The latching assembly 810 is affixed to the housing 200. The latching assembly 810 includes a button member 820 and a spring 840 coupled thereto. The button member 820 is horizontally movable along a frame portion of latching assembly 810 between a latched and an unlatched position. An external force, such as a user applied force, may be applied on the button member 820 to move the button member 820 towards the left in FIG. 9 (shown by arrow A) to the unlatched position. When the external force is released, the spring 840 urges the button member 820 towards the right in FIG. 9 (shown by arrow B) to the latched position.

The button member 820 is coupled to a latch member 850 movable therewith. The latch member 850 may include a pin member 860. The latch member 850 is engageble with a latching member provided on the door 800. For example, the door 800 may include a latching member 870 resembling an inverted "4" shape (shown in FIG. 10) that is engageble with the pin member 860 of the latch member 850. FIGS. 10 (A, B, and C) illustrates a downward movement of the latching member 870 (shown by arrow Y) to engage the pin member 860 when door 800 is moved to the closed position and latched to housing 200.

Usually, when the door 800 is not latched with the latching assembly 810, a spring (not shown) coupled to the door 800 urges it to the open position. In the open position, the toner cartridge is accessible. In order to latch the door 800 to the latching assembly 810, the door 800 is closed and the door 800 is moved downward by applying an external, user applied force thereto. When the door 800 is moved downward, the door's latching member 870 (the inverted 4 shape) moves into engagement with the pin member 860 (as shown in FIG. 10, A-C). Specifically, as the door 800 is moved further downward, the door's latching member 870 temporarily moves the pin member 860 along with the button member 820 towards the left (indicated by arrow A in FIG. 9) to the unlatched position, overcoming the spring force applied by the spring 840. This temporary displacement of pin member 860 can be seen as latching member 870 moves from position A to position B in FIG. 10. However, once the door's latching member 870 engages with the pin member 860 (position C of FIG. 10), the spring 840 applies a force to move the button member 820 along with the pin member 860 towards the right (indicated by arrow B in FIG. 9) to the latched position. In the latched position, the door 800 is latched with the latching assembly 810.

In the latched position, the controller 140 energizes the bidirectional solenoid 300 in the first direction to move the plunger 150*b* in a direction indicated by arrow R (see FIG. 9) to the locked position. In the locked position, the plunger 150*b* engages a portion of the latching member 810. For example, the plunger 150*b* may engage the button member 820. Once the plunger 150*b* is so engaged, the button member 820 may not be moved from the latched position, thereby locking the door 800 in the closed position. In the closed position, the door 800 cannot be opened.

In general terms, the operation of the locking mechanism of embodiment of FIGS. 8-10 follows the flow chart of FIG. 7. In order to move the plunger 150*b* to the unlocked position, a code is entered into the image forming device 110. The I/O interface 160 provides an option for entering the code for unlocking the door 800 of the cover 120'. When the code is entered into the image forming device 110, the controller 140 determines if the code is the correct code for unlocking the door 800. If the code is the correct code the controller 140 controls the bidirectional solenoid 300 to move the plunger 150*b* in a direction indicated by arrow L to the unlocked position. The controller 140 energizes the bidirectional solenoid 300 in the second direction to move the plunger 150*b* to the unlocked position. In the unlocked position, the plunger 150*b* is disengaged from the button member 820.

When the plunger 150*b* is disengaged from the button member 820, the button member 820 may be moved to the unlatched position by applying an external force. In the unlatched position, the pin member 860 disengages from the door's latching member 870 and the spring coupled to the door 800 urges the door 800 to the open position. In the open position, the toner cartridge(s) is/are accessible.

In one embodiment, the controller 140 energizes the bidirectional solenoid 300 to unlock the door 800 only when the image forming device 110 is not printing. In another embodiment, the controller 140 automatically energizes the bidirectional solenoid 300 in the second direction to unlock the door 800 when the toner cartridge is consumed.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. An electronic locking system to secure a consumable item in an image forming device comprising:

a first member to hold the consumable item and movable between an open position and a closed position, the first member being in the open position provides access to the consumable item;

a receiving member configured to receive the first member, the receiving member including a locking member; and a controller for controlling the locking member to lock the first member to the receiving member when the first member is in the closed position, and to unlock the first member from the receiving member so that the first member is movable to the open position, wherein the locking member includes a drive device coupled to the controller and a plunger, the plunger is moved by the drive device between a locked and an unlocked position, and the controller controls the drive device to move the plunger to the unlocked position only when the image forming device is not printing such that movement of the plunger to the unlocked position is delayed until an ongoing print operation is complete.

2. The electronic locking system of claim 1, wherein the controller is configured to control the drive device to move the plunger to engage a portion of the first member in the locked position, and to move the plunger to disengage from the portion of the first member in the unlocked position.

3. The electronic locking system of claim 2, wherein the image forming device includes an interface for receiving codes, and wherein when a correct code is received the controller controls the drive device to move the plunger to the unlocked position.

4. The electronic locking system of claim 3, wherein the interface receives the code from at least one of a user and a device on which the code is stored.

5. The electronic locking system of claim 3, wherein the controller records the time the correct code is entered into the image forming device and stores in memory the recorded time along with the corresponding correct code for use in subsequently tracing a user of the image forming device who provided thereto the correct code to move the plunger to the unlocked position.

6. The electronic locking system of claim 1, wherein the first member comprises a media tray, the consumable item comprises one or more sheets of media, and the receiving member comprises a tray receiving member.

7. The electronic locking system of claim 6, wherein the tray receiving member includes a sensing member which detects the media tray being positioned inside the tray receiving member, and in response to a detection by the sensing member the controller controls the drive device to move the plunger to the locked position.

8. The electronic locking system of claim 7, following the controller controlling the drive device to move the plunger to the unlocked position, the controller controls the drive device to move the plunger to the locked position upon completion of a predetermined time period during which the media tray remains positioned inside the tray receiving member as sensed by the sensing member.

9. The electronic locking system of claim 6, wherein the controller controls the drive device to automatically move the plunger to the unlocked position if the media tray is empty.

10. A method for locking and unlocking a media tray in an image forming device comprising:

detecting, by the image forming device, the media tray being in a closed position relative to the image forming device and locking, by the image forming device, the media tray in the closed position in response to the detection;

receiving, by the image forming device, a code from a user of the image forming device;

determining, by the image forming device, if the code is a predetermined code; and unlocking, by the image forming device, the media tray based upon the determination, wherein unlocking the media tray is delayed relative to the determination until an ongoing print job is complete.

11. The method of claim 10, further comprising:

following unlocking the media tray, locking the media tray upon completion of a predetermined time period during which the media tray remains in the closed position.

12. The method of claim 10, further comprising automatically unlocking the media tray upon determining the media tray to be empty.

13. An electronic locking system to secure a consumable item in an image forming device, comprising:

a first member to hold the consumable item within the image forming device and movable between an open position and a closed position, the first member being in the open position provides access to the consumable item and in the closed position during a printing operation;

a receiving member configured to receive the first member, the receiving member including a locking member; and a controller for controlling the locking member to lock the first member to the receiving member when the first member is in the closed position, and to unlock the first member from the receiving member so that the first member is movable to the open position, wherein the locking member includes a drive device and a plunger, the plunger being moved by the drive device between a locked and an unlocked position, and the controller controlling the drive device to automatically move the plunger to the unlocked position if the consumable item has been depleted.

14. The electronic locking system of claim 13, wherein the first member comprises a media tray, the consumable item comprises one or more sheets of media, the receiving member comprises a tray receiving member, and the controller controlling the drive device to automatically move the plunger to the unlocked position if the media tray is empty.

15. The electronic locking system of claim 13, wherein the first member comprises a door of the image forming device, the receiving member includes a button manipulatable by a user of the image forming device to open the door and a latching assembly to latch the door in the closed position, and the plunger engages the button when in the locked position to prevent user-applied movement of the button and to lock the door to the receiving member and disengages with the button when in the unlocked position to allow for user-applied movement thereof.

16. The electronic locking system of claim 13, further comprising a sensing element for sensing the consumable item being positioned within the image forming device, wherein the controller returns the plunger to the locked position a predetermined period of time immediately following the plunger being moved to the unlocked position and during the predetermined period of time the sensing element detects that the consumable item remained within the image forming device.

17. The electronic locking system of claim 13, wherein the controller does not move the plunger to the unlocked position during the printing operation, and automatically moves the plunger to the locked position from the unlocked position upon the consumable item being inserted within the image forming device.

* * * * *